US009707623B2

(12) United States Patent
Lee

(10) Patent No.: US 9,707,623 B2
(45) **Date of Patent: *Jul. 18, 2017**

(54) COMPOSITE SYSTEM

(71) Applicant: Robert G. Lee, Portland, OR (US)

(72) Inventor: Robert G. Lee, Portland, OR (US)

( * ) Notice: Subject to any disclaimer, the term of this patent is extended or adjusted under 35 U.S.C. 154(b) by 748 days.

This patent is subject to a terminal disclaimer.

(21) Appl. No.: 14/083,047

(22) Filed: Nov. 18, 2013

(65) Prior Publication Data

US 2014/0154126 A1 Jun. 5, 2014

Related U.S. Application Data

(60) Division of application No. 13/544,888, filed on Jul. 9, 2012, now Pat. No. 8,608,822, which is a (Continued)

(51) Int. Cl.
*B22F 1/00* (2006.01)
*B22F 7/00* (2006.01)
(Continued)

(52) U.S. Cl.
CPC ..... *B22F 7/008* (2013.01); *B22F 7/02* (2013.01); *B22F 7/04* (2013.01); *B22F 7/062* (2013.01);
(Continued)

(58) Field of Classification Search
CPC ..... B22F 1/0003; B22F 2301/15; B22F 2301/205; C22C 1/023; C22C 1/03;
(Continued)

(56) References Cited

U.S. PATENT DOCUMENTS 2,751,668 A 6/1956 Turner, Jr. et al.
2,753,261 A 7/1956 Goetzel et al.
(Continued)

FOREIGN PATENT DOCUMENTS

JP 03-044431 2/1991
JP H03 150331 A 6/1991
(Continued)

OTHER PUBLICATIONS

James F. Shackelford and William Alexander, CRC Materials Science and Engineering Handbook, Third Ed., CRC Press, 2001, pp. 60-64.*

(Continued)

*Primary Examiner* — Roy King
*Assistant Examiner* — Vanessa Luk
(74) *Attorney, Agent, or Firm* — Klarquist Sparkman, LLP

(57) ABSTRACT

A multiphase composite system is made by binding hard particles, such as TiC particles, of various sizes with a mixture of titanium powder and aluminum, nickel, and titanium in a master alloy or as elemental materials to produce a composite system that has advantageous energy absorbing characteristics. The multiple phases of this composite system include an aggregate phase of hard particles bound with a matrix phase. The matrix phase has at least two phases with varying amounts of aluminum, nickel, and titanium. The matrix phase forms a bond with the hard particles and has varying degrees of hard and ductile phases. The composite system may be used alone or bonded to other materials such as bodies of titanium or ceramic in the manufacture of ballistic armor tiles.

28 Claims, 16 Drawing Sheets

Related U.S. Application Data continuation of application No. PCT/US2010/029088, filed on Mar. 29, 2010, which is a continuation-in-part of application No. 11/695,588, filed on Apr. 2, 2007, now Pat. No. 7,687,023.

(60) Provisional application No. 60/787,841, filed on Mar. 31, 2006.

(51) Int. Cl.

| | |
|---|---|
| ***B22F 7/02*** | (2006.01) |
| ***B22F 7/04*** | (2006.01) |
| ***C22C 29/00*** | (2006.01) |
| ***C22C 32/00*** | (2006.01) |
| ***F41H 5/04*** | (2006.01) |
| ***C22B 5/06*** | (2006.01) |
| ***C22B 34/12*** | (2006.01) |
| ***C22C 29/10*** | (2006.01) |
| ***B22F 7/06*** | (2006.01) |
| ***B22F 7/08*** | (2006.01) |
| ***C22C 1/10*** | (2006.01) |
| ***C22C 29/06*** | (2006.01) |
| *C22B 1/245* | (2006.01) |

(52) U.S. Cl.

CPC ..... *B22F 7/08* (2013.01); *C22B 5/06* (2013.01); *C22B 34/1281* (2013.01); *C22C 1/1068* (2013.01); *C22C 29/00* (2013.01); *C22C 29/067* (2013.01); *C22C 29/10* (2013.01); *C22C 32/0047* (2013.01); *C22C 32/0052* (2013.01); *F41H 5/04* (2013.01); *B22F 2998/10* (2013.01); *B22F 2999/00* (2013.01); *C22B 1/245* (2013.01); *Y10T 156/10* (2015.01); *Y10T 428/12493* (2015.01); *Y10T 428/31678* (2015.04)

(58) Field of Classification Search

CPC ..... C22C 1/0433; C22C 1/0458; C22C 1/05; C22C 1/051; C22C 14/00; C22C 19/007; C22C 19/03; C22C 26/00; C22C 2026/003; C22C 2026/005; C22C 2026/006; C22C 2026/007; C22C 2026/008

See application file for complete search history.

(56) References Cited

U.S. PATENT DOCUMENTS

| | | | | |
|---|---|---|---|---|
| 2,929,126 | A | 3/1960 | Bollack et al. | |
| 3,052,538 | A | 9/1962 | Jech et al. | |
| 3,676,161 | A | 7/1972 | Yates | |
| 3,785,801 | A * | 1/1974 | Benjamin | B22F 9/04 419/1 |
| 3,865,586 | A | 2/1975 | Volin et al. | |
| 4,194,910 | A | 3/1980 | Mal et al. | |
| 4,636,252 | A | 1/1987 | Yoshimura et al. | |
| 4,731,115 | A | 3/1988 | Abkowitz et al. | |
| 4,915,903 | A | 4/1990 | Brupbacher et al. | |
| 4,919,718 | A | 4/1990 | Tiegs et al. | |
| 4,946,643 | A | 8/1990 | Dunmead et al. | |
| 4,987,033 | A | 1/1991 | Abkowitz et al. | |
| 5,015,290 | A | 5/1991 | Tiegs et al. | |
| 5,041,261 | A | 8/1991 | Buljan et al. | |
| 5,098,469 | A * | 3/1992 | Rezhets | C22C 1/0433 419/32 |
| 5,271,758 | A * | 12/1993 | Buljan | C04B 35/117 75/232 |
| 5,409,518 | A | 4/1995 | Saito et al. | |
| 5,520,879 | A | 5/1996 | Saito et al. | |
| 5,543,235 | A | 8/1996 | Mirchandani et al. | |
| 5,736,658 | A | 4/1998 | Mirchandani et al. | |
| 6,117,204 | A | 9/2000 | Saito et al. | |
| 6,387,196 | B1 | 5/2002 | Yamaguchi et al. | |
| 6,551,371 | B1 | 4/2003 | Furuta et al. | |
| 6,607,693 | B1 | 8/2003 | Saito et al. | |
| 6,849,230 | B1 | 2/2005 | Feichtinger | |
| 7,354,548 | B2 | 4/2008 | Liu | |
| 7,687,023 | B1 | 3/2010 | Lee | |
| 8,608,822 | B2 | 12/2013 | Lee | |
| 8,936,751 | B2 | 1/2015 | Lee | |
| 2004/0141865 | A1 | 7/2004 | Keshavan et al. | |
| 2004/0231459 | A1 * | 11/2004 | Chun | B04C 5/085 75/241 |
| 2007/0227299 | A1 * | 10/2007 | Marchiando | B22F 3/115 75/244 |

FOREIGN PATENT DOCUMENTS

| | | |
|---|---|---|
| JP | H04 2742 A | 1/1992 |
| WO | WO 2005/023463 | 3/2005 |

OTHER PUBLICATIONS

International Search Report and Written Opinion issued in PCT/US2010/029088, mailed May 11, 2010, 11 pages.

Supplementary Search Report, dated Apr. 3, 2014, issued in EPC Application No. 10850356.6.

* cited by examiner

FIG. 1

Range of Elements Calculation

Composition of Each Ingredient

| | NiTiAl High | TiC | TSG |
|---|---|---|---|
| Ti | 28.00% | 80.58% | 100.00% |
| Al | 12.00% | | |
| C | 0.10% | 19.42% | |
| Fe | 4.50% | | |
| Si | 4.00% | | |
| Total | 48.60% | | |
| Ni | 51.40% | | |
| | 100.00% | 100.00% | 100.00% |

| | NiTiAl Low | TiC | TSG |
|---|---|---|---|
| Ti | 24.00% | 80.58% | 100.00% |
| Al | 7.00% | | |
| C | 0.00% | 19.42% | |
| Fe | 0.00% | | |
| Si | 0.00% | | |
| Total | 31.00% | | |
| Ni | 69.00% | | |
| | 100.00% | 100.00% | 100.00% |

Minimun Range of Components-High NiTiAl

| | NiTiAl | TiC | Ti | Comb |
|---|---|---|---|---|
| | 12.50% | 32.00% | 55.50% | 100.00% |
| Ti | 3.50% | 25.79% | 55.50% | 84.79% |
| Al | 1.50% | | | 1.50% |
| C | 0.01% | 6.21% | | 6.23% |
| Fe | 0.56% | | | 0.56% |
| Si | 0.50% | | | 0.50% |
| Ni | 6.43% | | | 6.43% |
| Proof | 12.50% | 32.00% | 55.50% | 100.00% |

Minimun Range of Components-Low NiTiAl

| | NiTiAl | TiC | Ti | Comb |
|---|---|---|---|---|
| | 12.50% | 32.00% | 55.50% | 100.00% |
| Ti | 3.00% | 25.79% | 55.50% | 84.29% |
| Al | 0.88% | | | 0.88% |
| C | 0.00% | 6.21% | | 6.21% |
| Fe | 0.00% | | | 0.00% |
| Si | 0.00% | | | 0.00% |
| Ni | 8.63% | | | 8.63% |
| | 12.50% | 32.00% | 55.50% | 100.00% |

Maximum Range of Components-High NiTiAl

| | NiTiAl | TiC | Ti | Comb |
|---|---|---|---|---|
| | 25.00% | 55.00% | 20.00% | 100.00% |
| Ti | 7.00% | 44.32% | 20.00% | 71.32% |
| Al | 3.00% | | | 3.00% |
| C | 0.03% | 10.68% | | 10.71% |
| Fe | 1.13% | | | 1.13% |
| Si | 1.00% | | | 1.00% |
| Ni | 12.85% | | | 12.85% |
| Proof | 25.00% | 55.00% | 20.00% | 100.00% |

Maximum Range of Component-Low NiTiAl

| | NiTiAl | TiC | Ti | Comb |
|---|---|---|---|---|
| | 25.00% | 55.00% | 20.00% | 100.00% |
| Ti | 6.00% | 44.32% | 20.00% | 70.32% |
| Al | 1.75% | | | 1.75% |
| C | 0.00% | 10.68% | | 10.68% |
| Fe | 0.00% | | | 0.00% |
| Si | 0.00% | | | 0.00% |
| Ni | 17.25% | | | 17.25% |
| | 25.00% | 55.00% | 20.00% | 100.00% |

COMPOSITE SYSTEM

CROSS REFERENCE TO RELATED APPLICATIONS

This is a division of application Ser. No. 13/544,888, filed Jul. 9, 2012, now U.S. Pat. No. 8,608,822 which is a continuation of International Application No. PCT/US2010/029088, filed Mar. 29, 2010, which is a continuation-in-part of application Ser. No. 11/695,588, filed Apr. 2, 2007, now U.S. Pat. No. 7,687,023, which claims the benefit of U.S. Provisional Application No. 60/787,841, filed Mar. 31, 2006, each of which is incorporated herein in its entirety.

BACKGROUND AND SUMMARY

This invention relates to alloy systems containing hard particles, such as particles of TiC.

Historically, TiC alloys have been formed by "cementing" very hard TiC powder (Vickers 3200) using binders made of nickel, molybdenum, niobium, and tungsten, with the binding elements typically constituting about 40 to 50% of the total weight of such an alloy.

Historically these TiC alloys are formed using powder metallurgy techniques from very fine particles, in particular, materials having a particle size under 20 microns, with a substantial portion being under 6 microns.

The hardness of such TiC alloys makes them attractive for use in ballistic armor and other applications, but the brittleness properties of such alloys is a drawback.

The metals historically used for binding in TiC alloys have relatively high densities, in particular, nickel at 8.9 g/cc, molybdenum at 10.22 g/cc, niobium at 8.57 g/cc, and tungsten at 19.3 g/cc. As a result, such composite TiC alloys have had a density of about 6 g/cc or higher. Materials of that high density are disadvantageous for ballistic armor, for which low weight is an important feature.

A new composite system described herein has superior properties, being not only hard, but also being much lighter in weight than 6 grams/cc and having better toughness characteristics than previously reported TiC alloys.

The composite systems described herein are formed from a hard powder as described herein, such as a TiC powder, combined with a green binder system of titanium sponge granules and/or other titanium powders and a binder system comprising titanium, nickel, and aluminum provided either as a master alloy or as elemental powders, which then are compressed and sintered. It is observed that the nickel forms lower melting point eutectoid-like structures when combined with the titanium of the green binder system.

Bodies of TiC composite systems described herein can bind with bodies of titanium or other materials, allowing for the production of layered composite armor structures. Such layered composite structures can have advantageous attachment configurations, and favorable weight, ductility, and ballistics properties.

BRIEF DESCRIPTION OF THE FIGURES

FIG. 1 is a schedule showing calculated chemical compositions of various TiC composite systems.

DETAILED DESCRIPTION

A composite system that is a multiphase alloy is produced by binding very hard particles of various sizes using master alloys or a blend of elemental materials and titanium powders. The composite system has characteristics that make the composite system particularly well suited for energy absorption.

Figure 4A:
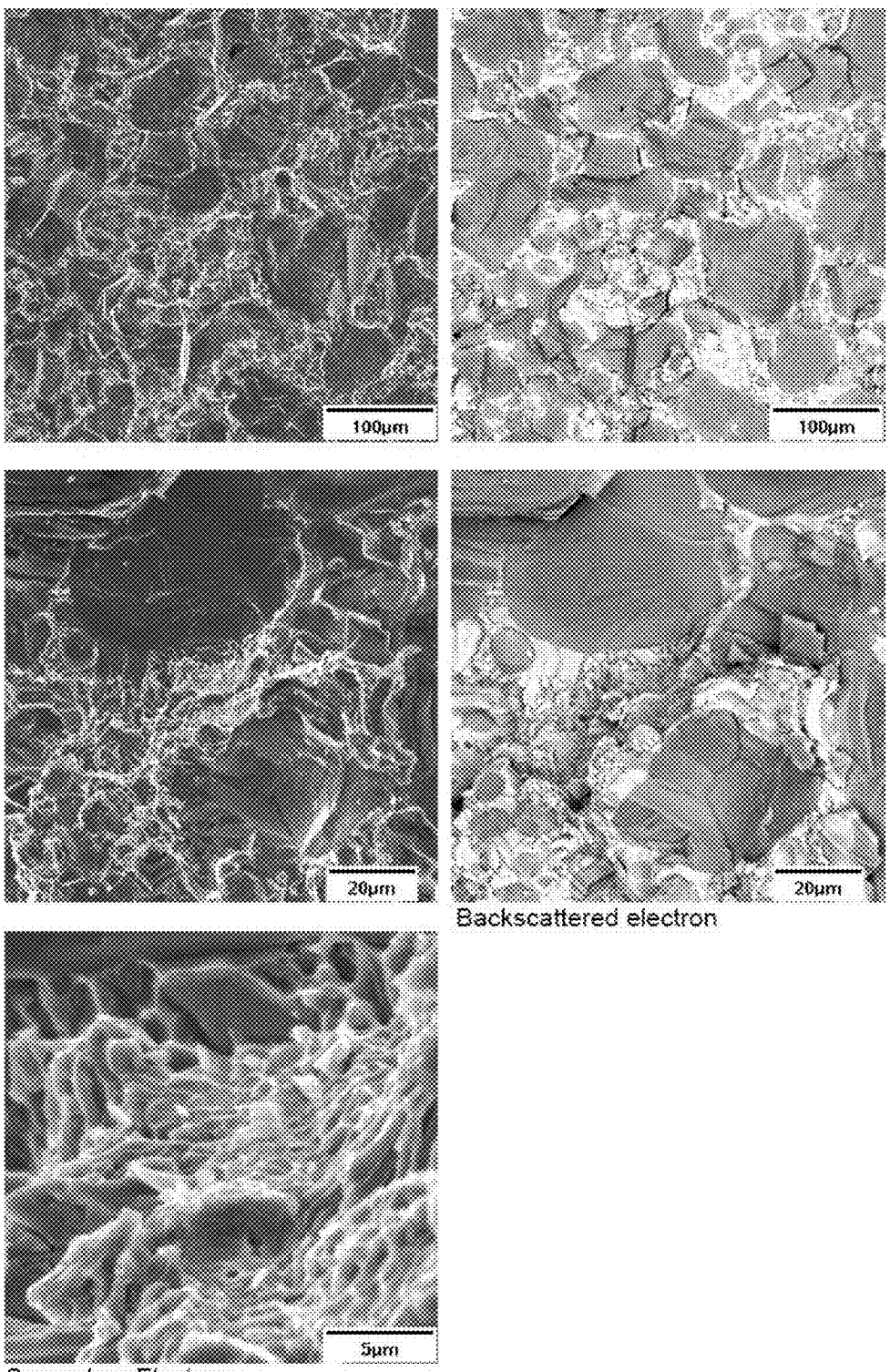
FIG. 4*a* includes SEM micrographs that show secondary electron and backscattered electron images of the TiC composite system layer fracture surface of the tile of FIG. 3*a* and that identify structure and cracking patterns that result when the tile is impacted and account for the enhanced energy absorption and superior ballistics performance of the tile of FIG. 3*a*. The three secondary electron images indicate a mixed ductile/brittle fracture. Comparison of the backscattered electron and secondary electron images indicates brittle faceted fracture of a low density aggregate phase and ductile fracture of a higher density matrix phase.
Figure 4B:
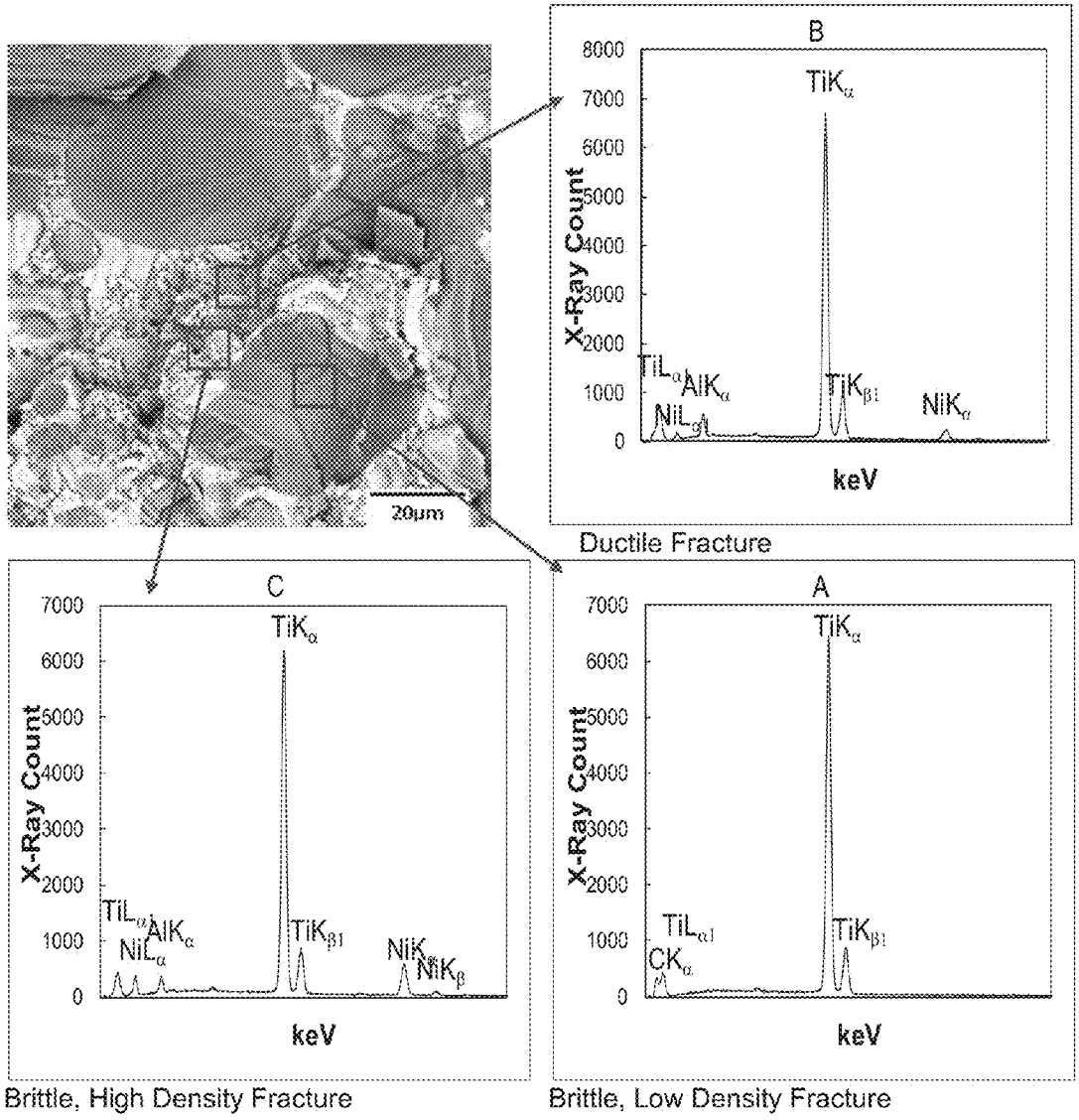
FIG. 4*b* includes an SEM micrograph that shows a backscattered electron image and energy dispersive x-ray spectra acquired from ductile and brittle areas of the TiC composite fracture surface of the tile of FIG. 3*a*. The results suggest a two phase matrix consisting of a lower nickel, nickel-titanium alloy and a higher nickel, nickel-titanium alloy. Ductile fracture appears to be confined to the lower nickel matrix phase.

The composite system has an aggregate phase of hard particles and a matrix phase that binds the hard particles together. FIGS. 2*b* and 4*a*-4*f* illustrate an example of such a composite system in which the hard particles are TiC (referred to as TiC composite systems or TiCC). Testing of examples of such TiC composite systems indicates that the matrix phase, which comprises amounts of nickel, titanium, and aluminum, has at least two phases as shown in FIG. 4*b*. The phases of nickel, titanium, aluminum matrix phase have varying degrees of hardness and ductility.

The slightly ductile matrix phase is believed to be responsible for an observed tortuous crack propagation pattern, as shown in FIGS. 4*a*-4*f*, that forms when a body of the TiC composite system is subjected to ballistics trauma such as by impact with a high velocity ballistic projectile. Crack propagation progresses in very random directions and redirections, which is believed to enhance rapid absorption of a projectile's energy. The TiC composite system thereby exhibits a greater toughness than prior materials that are brittle and rapidly shatter in straight line crack patterns.

The bonding of the matrix phase with the aggregate phase also serves to reduce cracking of the relatively brittle hard particles which constitute the aggregate phase.

As described below, the composite system has hard particles that are relatively large such that there is more space between the hard particles to be occupied by the more ductile matrix phases than in prior composites. Because of their size, such large hard particles have a relatively large mass to better absorb energy and resist cracking.

These are significant advantages because the increased energy absorption ability of the presently described composite system makes the composite system better suited for use in ballistic armor and certain other applications.

The composite system may be formed from a mixture comprising (1) titanium powder, such as titanium sponge granules (TSGs), (2) a master alloy containing nickel, titanium, aluminum, and optionally, iron (NiTiAl master alloy), and (3) hard powder. The materials are combined in a mixture in the following amounts:

titanium powder from 20 wt. % to 54 wt. %,
NiTiAl master alloy from 12.5 wt. % to 25 wt. %, and
hard powder from 32 wt. % to 55 wt. %.

Such a mixture of NiTiAl master alloy and titanium powder has a melting point below their respective melting points and well below the melting point of the hard powder. As a result, melting and then cooling the NiTiAl master alloy and titanium powder in such a mixture produces a composite system having a lamellar microstructure.

A master alloy is a composition made for the purpose of melting and/or bonding with other metals to form composite systems or other alloys. Master alloys are used to overcome the problems of alloying metals of widely differing melting points, or to facilitate closer control over the final composition. Such a master alloy is made by melting or exothermic reaction of the metals making up the composition; and the resulting mixture which is very friable is reduced to the desired particle size by mechanical methods before blending with other components of the product alloy.

Non-melted titanium sponge granules (TSGs) are believed to be best titanium powders to use for the green binder for forming the composite systems described herein. For the purposes of this disclosure, TSGs are defined as irregular shaped particles of sponge fines from titanium metal reduction processes using sodium, magnesium or calcium as the reducing agent to extract the titanium and where the titanium sponge granules have not been melted. For the procedures described herein, best results are achieved using TSGs made with a process using sodium as the reducing agent, although other soft, non-melted titanium sponge granules could be used. TSGs have a low apparent density, below 1.50 g/cc and a low tap density, specifically a tap density of less than 1.90 g/cc.

While non-melted TSGs are believed to be best, it is also possible to use titanium powder made from melted powders such as those made by the hydride-dehydride process using previously melted titanium material, or by using spherical titanium powders that may be made by the rotating electrode process, commonly known as REP method. Spherical powders are also made by a plasma process such as that used by TEKNA Plasma Systems, where titanium sponge particles or particles made by other methods such as HDH are fed through an induction plasma on controlled basis and fully or partially melted to form spherical type titanium powders. The green binder also can be a mixture of such titanium powders with or without TSGs.

"Hard powder" as referred to herein includes powders, particles and/or granules that are so hard that a volume of hard powder will not stick together when compacted in a die to form a compact for subsequent processing by the application of heat and/or pressure such as sintering, hot pressing, and hot isostatic pressing, without contamination of the base material or subsequently formed alloy. Hard powders include many different types of carbides and nitrides. Hard powders of particular utility are aluminum carbide, $Al_4C_3$, boron carbide, $B_4C$, silicon carbide, SiC, calcium carbide, $CaC_2$, titanium carbide, TiC, titanium nitride, TiN, and boron nitride, BN. Another suitable hard powder is $Al_2O_3$. Mixtures of such materials can be used as the hard powder component for forming the composite system. Low density hard particles, having a specific gravity of not more than 6.0, are particularly useful in forming ballistic armor for portable uses, such as in body armor.

The starting materials and alloys described in this disclosure typically will contain small amounts of other elements, sometimes referred to herein as "trace elements," including residuals, impurities, dopants, and the like. Commercially available component materials typically contain small amounts of one or more of O, H, N, Na, Cl, Co, Cr, Cu, Mg, Mn, Mo, Nb, Pd, Sb, Sn, Ta, V, W, Zr, and S. The exact amounts of such elements in starting materials typically is not known because commercially available component materials are not routinely assayed for all possible included elements. Therefore the main elements, i.e. titanium and nickel, are normally established by subtracting the elements analyzed for from 100%. Industry specifications for titanium alloys vary widely in the number of elements analyzed for. Best results are achieved if such other elements do not constitute more than 1% of a product composite system.

The titanium powder serves to bind together the hard powders and the hard NiTiAl master alloy so that the blend can be compacted by normal powder metal techniques in closed die using mechanical or hydraulic presses to form green compacts. In this way, relatively high production rates can be achieved without scoring of a die with the hard components. Titanium sponge granules thus should be present in an amount sufficient to impart green strength to a green compact formed from the mixture of ingredient materials.

By one method, NiTiAl master alloy is combined with TiC and TSGs to form a TiC composite system.

The master alloy comprises:

24 wt. % to 28 wt. % titanium,
7 wt. % to 12 wt. % aluminum,
0 wt. % to 0.1 wt. % carbon,
0 wt. % to 4.5 wt. % iron,
0 wt. % to 4 wt. % silicon,
with the balance being nickel and trace elements.

This master alloy is friable and can be milled to fine powder of various sizes.

To complete formation of the composite system, the mixture is compacted at forces ranging from 275 MPa to 827 MPa to form a green compact.

The pressed green compact is sintered in a vacuum furnace at temperatures from 900° C. to 1400° C. depending on the ratios of nickel, TiC, and TSG in the mixture. The compact may also be processed by hot isostatic pressing (HIP) either before or after vacuum sintering.

Good results are achieved with particle sizes of minus 425 micron for the NiTiAl master alloy, hard powder, and the titanium powder. However, for the NiTiAl master alloy and the titanium powder it is best to use finer mesh sizes such as minus 150 microns depending on the application and desired structure. For some compositions it may be desirable for the size of the NiTiAl master alloy and the titanium powder to be as fine as minus 45 microns.

Figure 2A:
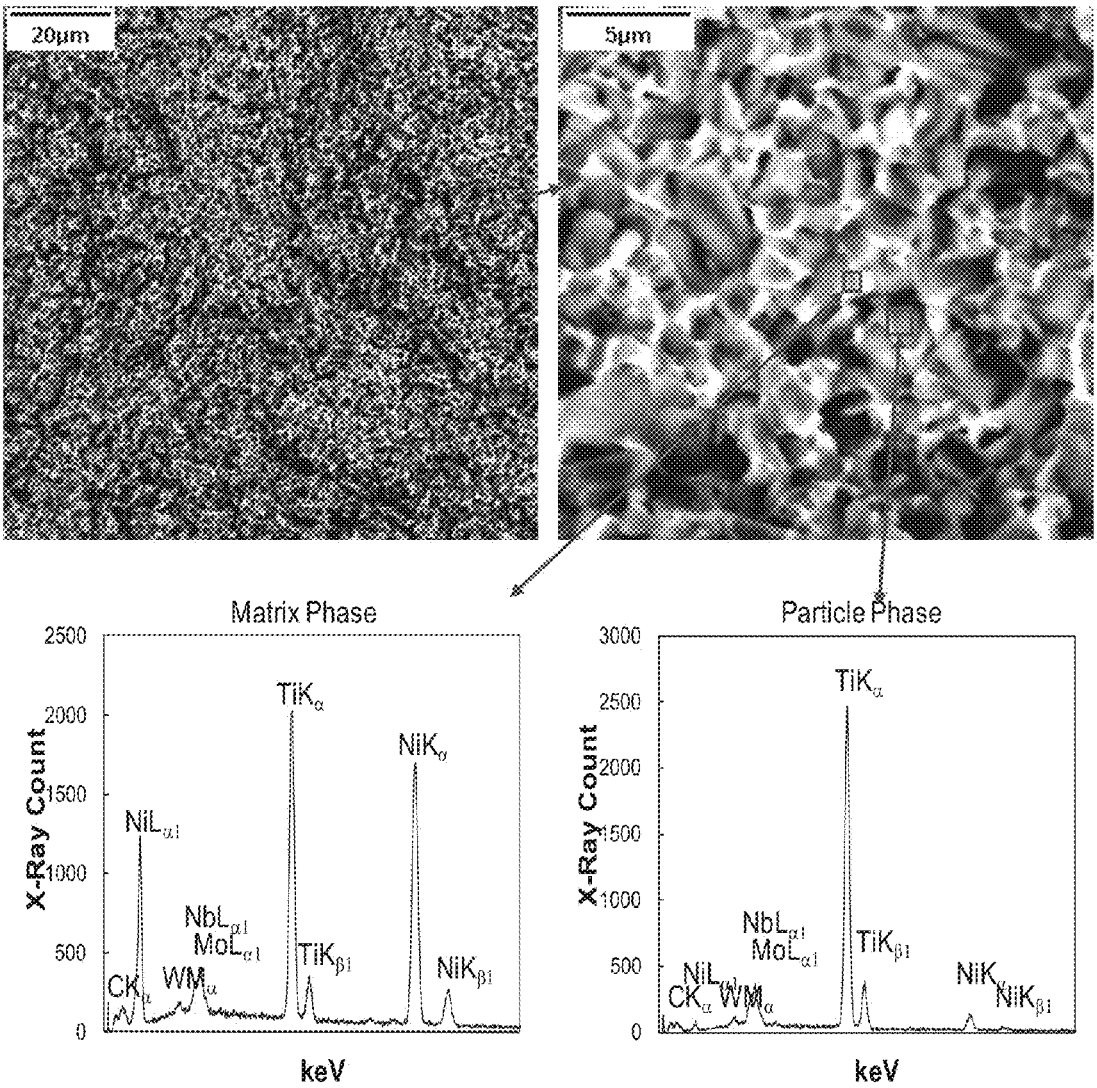
FIG. 2*a* includes SEM micrographs showing backscattered electron images and energy dispersive x-ray spectra acquired from the fracture surface of a prior art material that is believed to be an alloy that contains titanium carbide as the principal ingredient and nickel-molybdenum as a binder material.
Figure 2B:
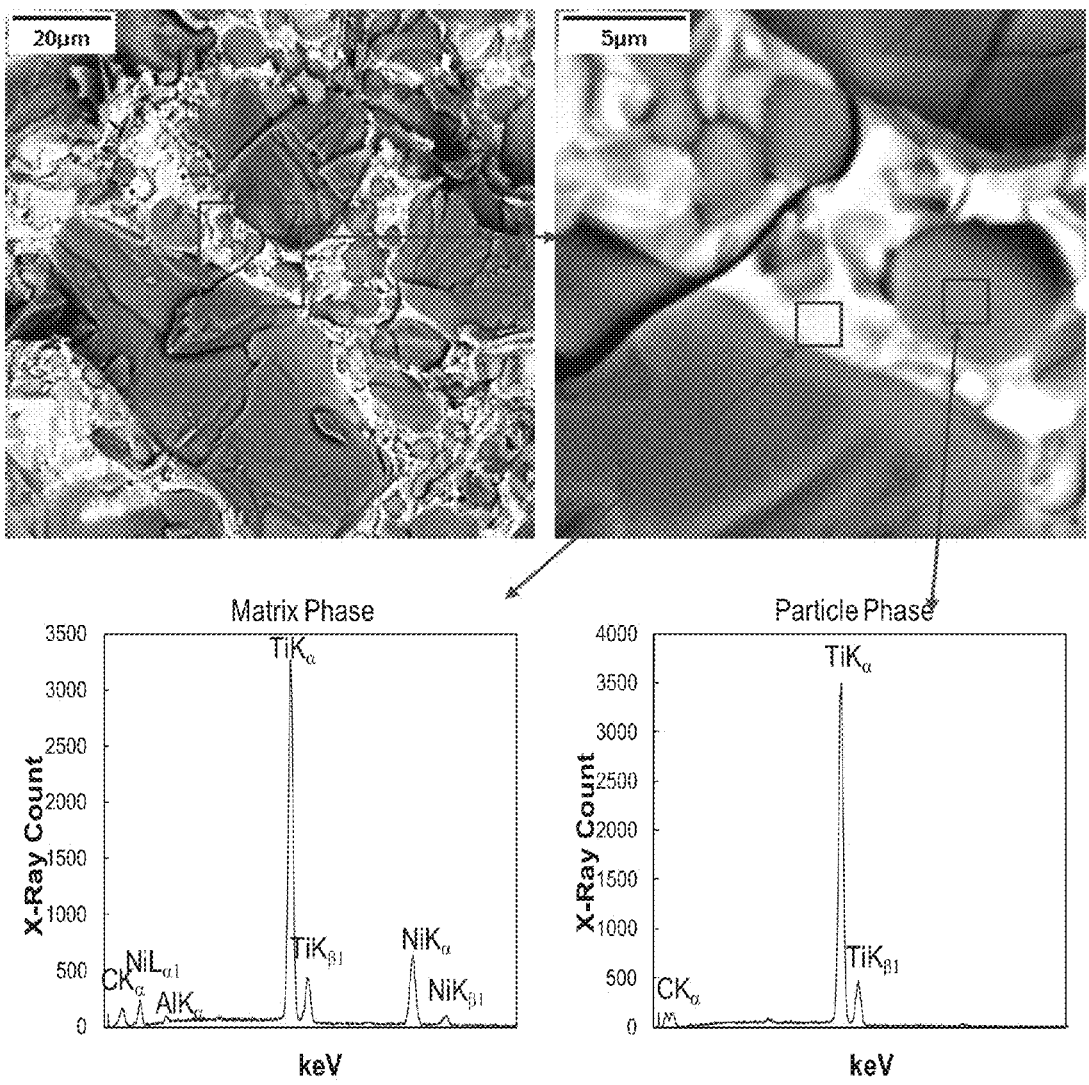
FIG. 2*b* includes SEM micrographs showing backscattered electron images and energy dispersive x-ray spectra acquired from the fracture surface of a TiC composite system described herein, the images showing TiC particles in the aggregate phase that are larger than any of the grains in the materials of FIG. 2*a* and FIG. 2*c*.
Figure 2C:
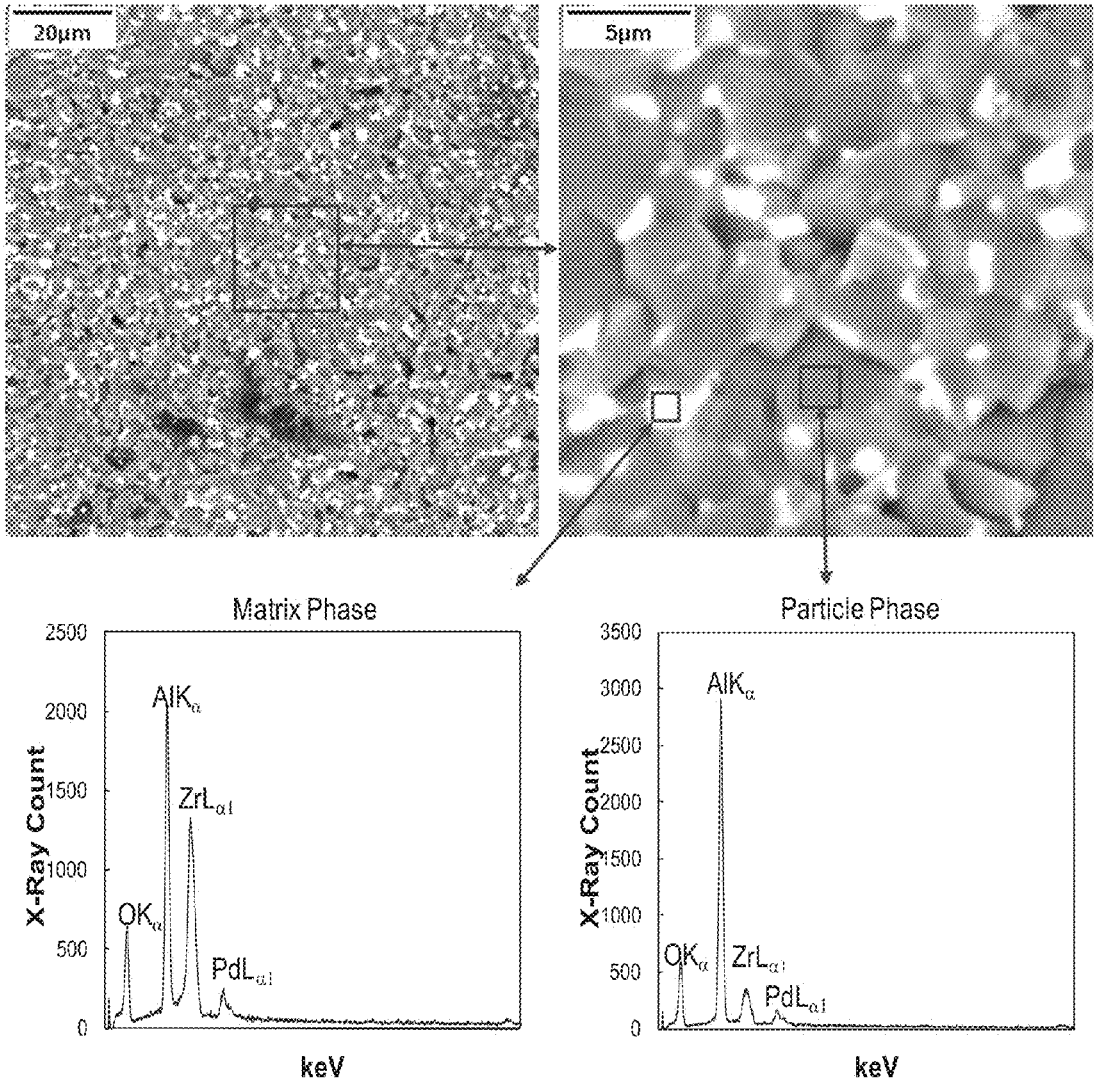
FIG. 2*c* includes SEM micrographs showing backscattered electron images and energy dispersive x-ray spectra acquired from the fracture surface of a prior art ceramic material believed to be used for making armor tiles.

The majority of the hard powder material input weight will comprise particles of various sizes in the range of 50-150 microns. A small fraction may be smaller in size, as small as 5 microns. Advantageously, at least 60 wt. % of the hard powder material input weight will comprise particles of at least 45 microns to achieve the desired aggregate mixture and spacing. The use of such relatively large particles is a departure from prior material systems. In the manufacture of traditional parts for ballistic armor, the majority of particles in the ingredient mixture are below 10 microns and most below 6 microns. In general, TiC particles in prior material systems are relatively small in size as shown in FIGS. 2*a* and 2*c*.

Other composite systems, appropriate for certain uses, can be formed from a powder mixture wherein 90 wt. % of the hard powder is less than 45 microns.

The size of the particles of each ingredient powder used can be varied to produce different green compacts and sintered structures depending on desired properties, pressing, and sintering parameters.

The composition of the resulting composite system will vary within ranges depending on the variations in the input materials and the allowable variations in the elements in the master alloy.

As an example, for a TiC composite system, by the calculations shown in FIG. 1, the composition will fall within the following ranges where the ingredient materials are adjusted to produce a final composition that is equal to 100% within the limitations shown below:

71 wt. % to 85 wt. % titanium
6 wt. % to 17 wt. % nickel,
1 wt. % to 4 wt. % aluminum,
0 wt. % to 1 wt. % iron,
0 wt. % to 1 wt. % silicon,
6 wt % to 11 wt % carbon
0 wt. % to 1.5 wt. % other elements.

The density of the composite system will vary depending on the ratios of the input materials and can be as high as 5.0 grams/cc. Measured densities of experimental TiC composite systems have ranged from 3.63 grams/cc to 4.42 grams/cc.

The composite system has an average hardness as measured by Vickers indenters of not less than 1000, with the lowest reading not less than 660 Vickers. Ductility and fracture toughness of the composite system are characterized by the formation of multiple ductile and brittle, branched, tortuous, energy absorbing crack paths with measurable deformation upon impact by a ballistic projectile and by ductility of at least 0.5% elongation.

It is most efficient to make parts of the composite system by sintering compressed powder compacts as discussed above. Furthermore, it is most efficient to make "net shape" parts which retain a desired shape and dimensions during sintering. To maintain desired shape and dimensions, the liquid phase of the composite system precursor powder must be controlled during the sintering of such parts. The degree to which ingredients become liquid or partially liquid during a sintering cycle can be varied by changes in the ratios of the ingredients and the sintering time and temperature. Increasing the amount of TiC and decreasing the amount of NiTiAl master alloy will result in less melting or no melting. Sintering time and temperature should not be so great as to entirely melt the hard powder in the mixture.

Useful composite systems can, however, also be made by melting an ingredient mixture sufficiently to at least partially liquefy the NiTiAl master alloy and titanium components. The liquefied mixture may be poured into a solid mold configured to form an ingot or into a mold shaped to produce a specific final or preform configuration in the manner of investment casting or permanent mold casting technology. Favorable results are achieved when the ingredient mixture contains 32 wt % to 55 wt % hard powder.

Elemental Powders

Elemental powders may be substituted for all or a portion of the NiTiAl master alloy in the procedures discussed above, but use of the master alloy typically is most efficient.

The composition of the resulting TiC composite system will vary depending on the ratios of the input materials. By the calculations shown in FIG. 1, the composition will fall within the following ranges where the ingredient materials are adjusted to equal 100% which produces a final composition that is equal to 100% within the limitations shown below:

71 wt. % to 85 wt. % titanium
6 wt. % to 17 wt. % nickel,
1 wt. % to 4 wt. % aluminum,
0 wt. % to 1 wt. % iron,
0 wt. % to 1 wt. % silicon,
6 wt % to 11 wt % carbon
0 wt. % to 1.5 wt. % other elements.

Results

Table I is a summary of results of tests made on exemplary TiC composite systems as described herein.

TABLE I

Titanium Carbide Composite System

| | Sample ID | | | | | |
|---|---|---|---|---|---|---|
| | NiTi722 | T-2-825 | T-3-908 | Ti-4-922 | Ti-5-923 | S-3 |
| Type | Sandwich | Sandwich | Sandwich | Sandwich | Sandwich | |
| Input materials | | | | | | |
| TSG | 20.0% | 32.5% | 54.0% | 38.0% | 32.5% | 38.0% |
| NiTiAl master alloy | 25.0% | 12.5% | 14.0% | 14.0% | 12.5% | 14.0% |
| TiC | 55.0% | 55.0% | 32.0% | 48.0% | 55.0% | 48.0% |
| Total blend | 100% | 100% | 100% | 100% | 100% | 100% |
| Composition of composite | | | | | | |
| Ni percent of total | 16% | 8% | 9% | 9% | 8% | 9% |
| Al percent of total | 2% | 1% | 1% | 1% | 1% | 1% |
| Fe percent of total | 0% | 0% | 0% | 0% | 0% | 0% |
| C percent of total | 11% | 11% | 6% | 9% | 11% | 9% |
| Ti percent of total | 71% | 80% | 84% | 81% | 80% | 81% |
| Total listed | 100% | 100% | 100% | 100% | 100% | 100% |
| Sinter | | | | | | |
| Time-hours | 0.5 | 0.5 | 1.5 | 1.5 | 1.5 | 1.5 |
| Temp-degree F. | 2200 | 2200 | 2200 | 2200 | 2200 | 2200 |
| Hardness- | | | | | | |
| Vickers Average | 1711 | 1950 | 979 | 1278 | 1230 | Shot |
| Vickers Ave ex high | 1464 | 1683 | 947 | 1191 | 1123 | |
| Vickers Ave ex high & low | 1568 | 1862 | 1023 | 1213 | 1174 | |
| No of Vickers over 2400 | 3 | 4 | 0 | 0 | 0 | |

Notes
T-2-825 Has the highest number of hard spots. Appears to be smaller grain and more melt.
T-3-908 has no hard spots, i.e. above 2400 V. Has lower average Vickers. Perhaps the longer sinter time is dissolving the TiC.
Vickers readings taken at .050 intervals with 10 or more in each sample.

Layered Composite Structures

A body of the composite system material may be used by itself depending on the application. The composite system also may be used along with a body of another material, particularly a body of titanium, a titanium alloy, aluminum, an aluminum alloy, or a ceramic, to form a multi-component composite structure.

As used herein to discuss layered composite structures, the term "substrate" is used to refer to a material other than a composite system as described herein. The term "body" refers to a structure that can hold a shape, as opposed to a loose mixture of powders that cannot hold a shape unless confined within a vessel. A "green body" or "green compact" is a mixture of powders that have been pressed together to form a compact that can hold a shape, but that has not been sintered. "Substrate precursor powder" refers to a material or mixture of materials in powdered form that can be sintered or can be melted and cast to form a solid body of substrate material. "Composite system precursor powder" refers to a mixture of powders that can be sintered to form a solid body of composite system material.

In particular, one or more layers of the composite system and one or more layers of titanium, a titanium alloy, aluminum, an aluminum alloy, and/or a ceramic can be combined to form a layered composite structure. Such layered composite structures can be produced with single or multiple layers of various different thicknesses and combinations that will have different densities and properties. Example layered composite structures are illustrated in FIGS. 3*a* and 5*a*-5*e*.

Layered composite structures can be made, for example, by placing a volume of substrate precursor powder, such as loose commercially pure (CP) titanium powder, and a volume of composite system precursor powder mixture into a die in layers of desired thickness ratios, followed by pressing to form a compact and sintering as described herein. Powders of a titanium alloy, aluminum, an aluminum alloy, or a mixture of such powders also can be used with the composite system to form such composite structures to meet special application needs.

Layered composite structures also can be made from a volume of a powder and a preformed solid body that serves as a substrate. For example, a preformed wafer of the composite system material can be placed into physical contact with a volume of a powder of titanium, a titanium alloy, aluminum, or an aluminum alloy, or a mixture of such powders in a closed die. The wafer and the powder then are compressed within the die to cause the powder to form a layered compact that can be sintered to bond the powder to the wafer.

Preformed bodies, such as wafers, of one or each of the layer components can be used to form the composite structure. For example, a body of titanium, a titanium alloy, aluminum, an aluminum alloy, or a ceramic can be placed into physical contact with a body of the composite system and the bodies heated to a sufficient temperature to cause the bodies to adhere upon cooling.

In yet another method, a volume of composite system precursor powder is placed in a die and compressed to form a green compact. The green compact and a solid substrate body are placed in physical contact, with the substrate covering all or part of a surface of the green compact. The combined green compact and substrate then are heated to sinter the green compact and to bond the sintered green compact to the substrate.

Sintering in a separate furnace typically is most efficient for any of these methods where materials are compressed within a die. But as an alternative, the compressed layered structure can be heated in the die under pressure, by the procedure sometimes referred to as hot pressing, to bond the layers together.

It will be appreciated that these techniques can be combined. Multiple composite system layers and substrate layers may be formed and bonded using one or more of the various methods described.

In particular, various heating methods and temperatures can be used to bond different materials together, to allow for variations among materials that will behave differently at different temperatures, before and after heating.

Adjacent layers of a layered composite structure can be larger or smaller than one another in any dimension. A layer may be in the form of one or more wires or whiskers that can be included in a layered composite structure to provide reinforcement or an attachment mechanism.

There are many commercially available titanium alloys, now used in wrought form, as well as many different forms and compositions of ceramics and aluminum alloys that can be used to form layered composite structures. Example titanium alloys are described in *Materials Property Handbook—Titanium Alloys* (ed. R. Boyer, E. W. Collings, and G. Welsch; published 2009 by Titanium Information Group, Rotherham, UK. Other examples of suitable alloys can be found in *ASTM B265-09ae1 Standard Specification for Titanium and Titanium Alloy Strip, Sheet, and Plate* (Active Standard ASTM B265, developed by Subcommittee B10.01, Book of Standards Volume 02.04, 2009).

Further the use of titanium powder combined with other powders can create new alloys and materials with desirable properties for substrate layers. The selection of such materials that may be used as substrate layers will be driven by characteristics including but not limited to compatibility for bonding with a composite system layer, to reduce the weight of the layered composite system, to increase the ductility and crack absorption properties, to reduce the transfer of impact energy, and exterior or interior layers that are harder, or more ductile than the TiC composite system.

Of particular benefit as substrates are alloys that consist essentially of titanium and aluminum, with the aluminum being present in an amount of from 2 wt. % to 12 wt. %. Such an alloy can be produced from a powder that is a mixture consisting essentially of 88 wt. % to 98 wt. % titanium powder and 2 wt. % to 12 wt. % aluminum powder.

An example of such a titanium-aluminum alloy ($TiAl_{10}$) was formed from a substrate precursor powder mixture of 90 wt. % titanium sponge granules and 10 wt. % aluminum powder. The substrate precursor powder mixture was placed in a die and a volume of TiC composite system precursor powder was placed on top of the substrate precursor powder mixture. The powders then were compacted to form a green compact, which subsequently was sintered within the parameters described herein. A good metallurgical bond was observed similar to that shown in FIG. 3*a*.

As another example, a body of titanium sponge granules that had been previously pressed and sintered to create a solid wafer was placed on a pressed, but not sintered, green compact of TiC composite system precursor powder, the combined body was subjected to sintering conditions within the parameters described herein. The green compact was sintered and good metallurgical bond between the layers, similar to that shown in FIG. 3*a*, was observed.

Layered composite structures have been made using standard wrought titanium materials such as $Ti_6Al_4V$ including reinforcing wires, and titanium alloys made with mixtures of elemental powders, such as 90 wt. % titanium powder with 10 wt. % aluminum powder as described above.

In particular, a wrought CP titanium wire 0.095 inch diameter and a wrought $Ti_6Al_4V$ wire 0.080 inch diameter were placed on a volume of TiC composite system precursor powder in a die, pressed to imbed the wires and sintered as described herein. A good bond was observed between the wrought $Ti_6Al_4V$ wire and the TiC composite material, which when broken apart showed a ductile fracture within the $Ti_6Al_4V$ wire. The small diameter CP titanium wire was fully alloyed with and became a part of the matrix of the TiC composite system consistent with the observations that the TiC composite system forms a phase that will bond metallurgically with alloys of titanium and bodies of titanium that are thick enough to not be fully alloyed with the TiC composite system.

Armor Systems

Figure 3A:
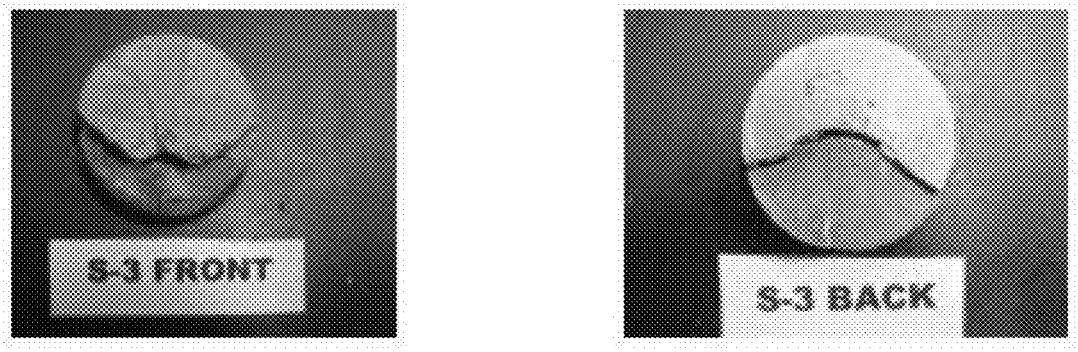
FIG. 3*a* is a photograph of a tile made of a TiC composite system described herein bonded to a substrate layer of titanium, the tile having defeated a high velocity impact by a 5.56 mm, 62 grain, full metal jacket bullet shot by a 16 inch barrel AR-15 rifle in a ballistics test.
Figure 3B:
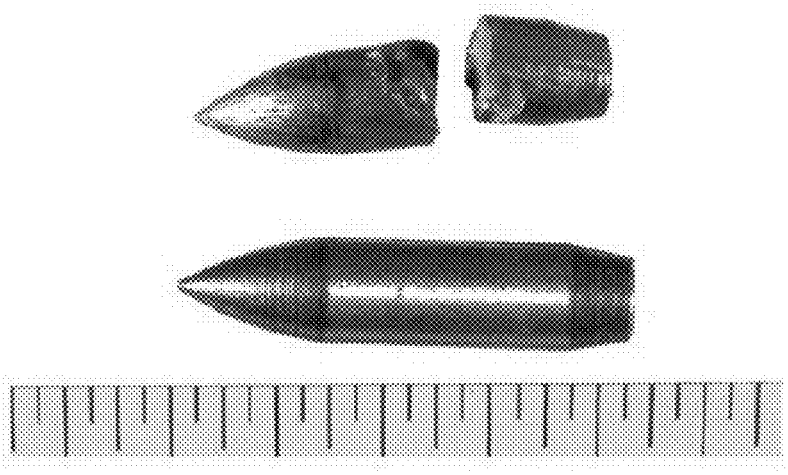
FIG. 3*b* is a photograph of the standard APM2 armor-piercing hardened steel penetrator (upper portion) that was defeated and broken by impact with the tile of the TiC composite system described herein in a ballistics test and a photograph of an unbroken APM2 penetrator (lower portion) shown for comparison.
Figure 3C:
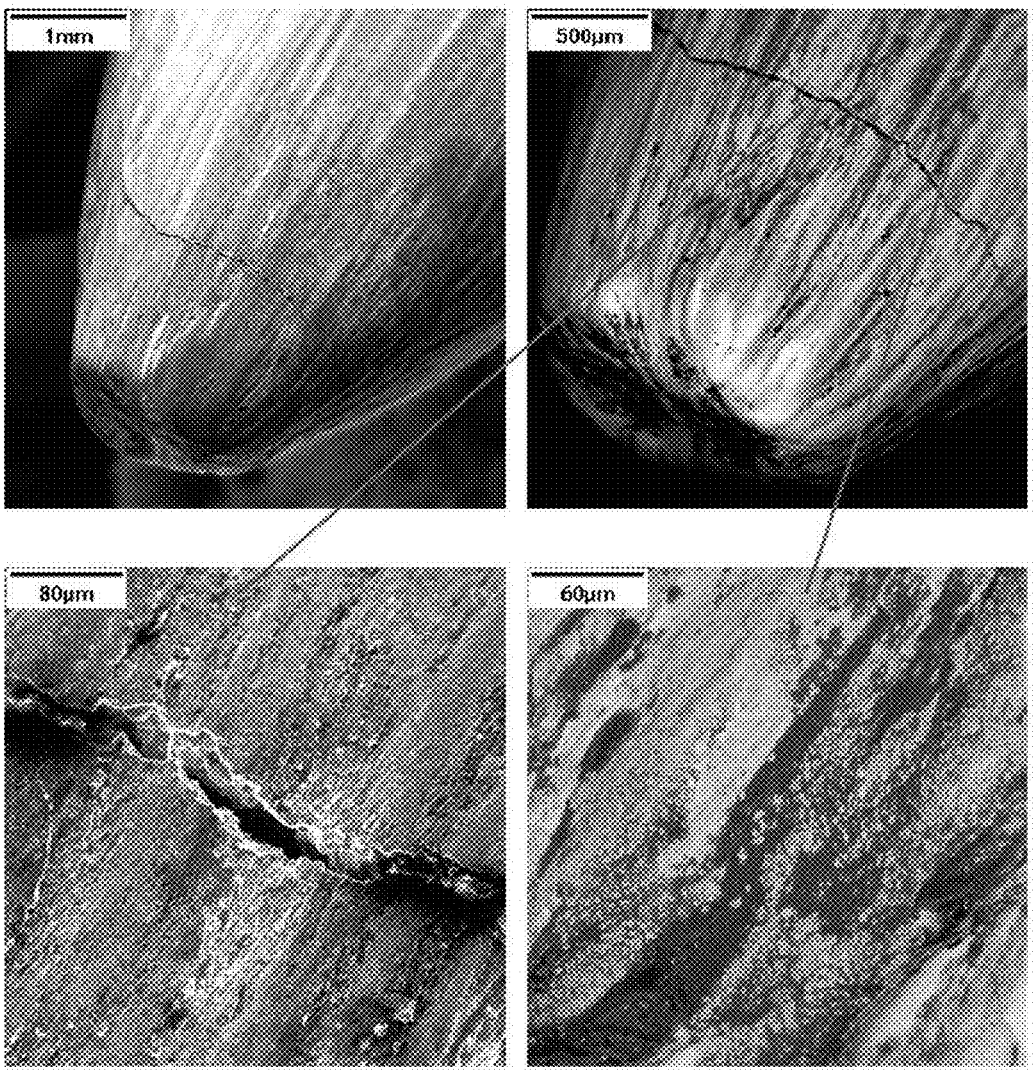
FIG. 3*c* includes SEM micrographs of the defeated APM2 penetrator of FIG. 3*b* showing cracking, a blunted tip, axial gouges and scoring, and deposition of a lower density material (darker areas).

FIG. 3*a* illustrates a potential application of a TiC composite system for armor tile. A wafer about 0.2 inch thick of the S-3 TiC composite system described in Table I was pressed and sintered onto an about 0.1 inch thick substrate layer of titanium sponge granules.

The resulting two-layer wafer was shot with an AR-15, 16 inch barrel, full metal jacket, standard NATO round. The TiC composite system portion of the composite was cracked and broken loose from the substrate but the bullet did not penetrate the substrate as shown in the photo of the back side of the two-layer wafer. The same type of bullet fully penetrated a mild steel target, about 0.25 inch thick, a ceramic armor tile about 0.24 inch thick and a TiC tile about 0.25 inch thick.

The tile shown in FIG. 3*a* was found to have the following properties.

Figure 4C:
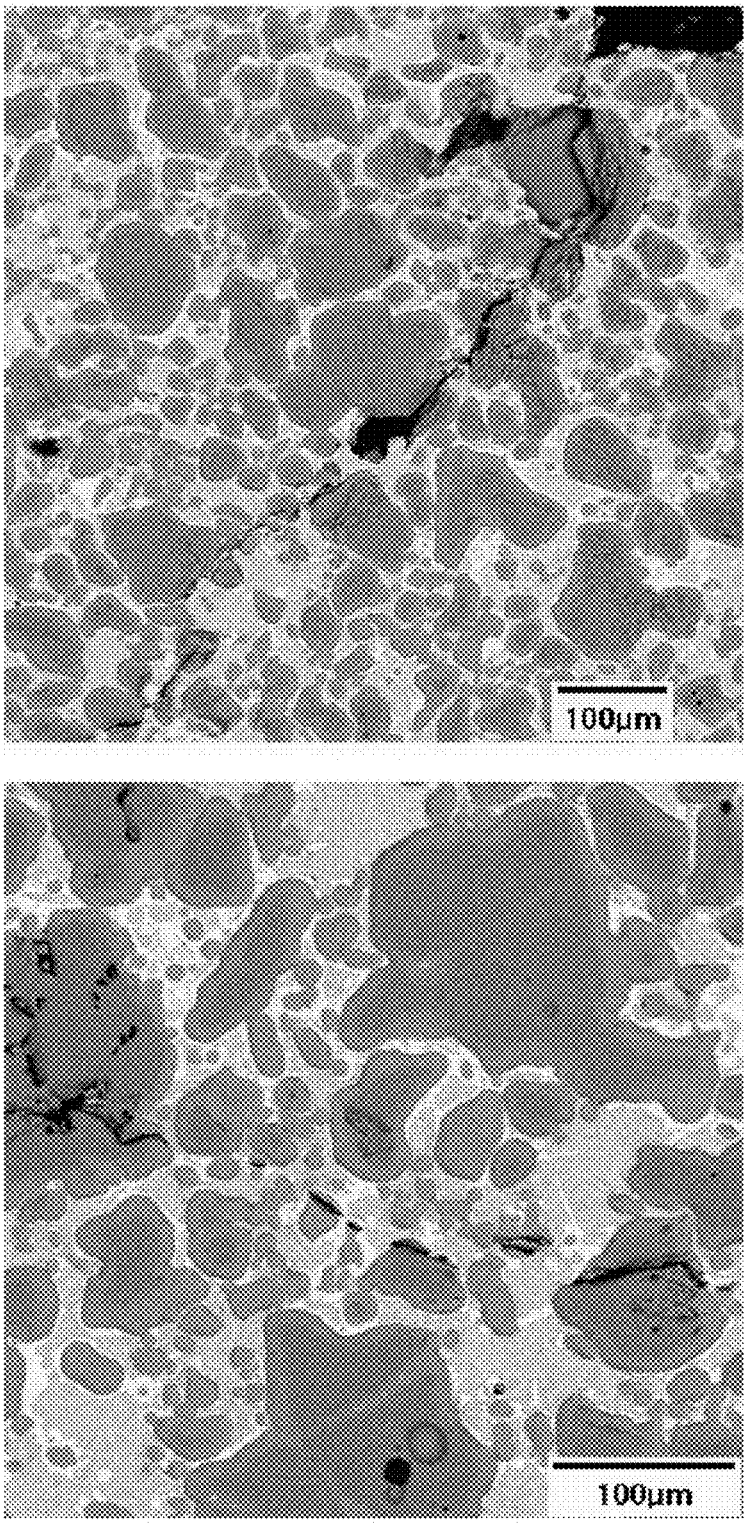
FIG. 4*c* includes SEM micrographs that show backscattered electron images of a metallographic section through secondary cracking through the TiC composite layer of the tile of FIG. 3*a*. The TiC composite includes a low density aggregate phase (titanium carbide) and a two phase (white and light grey) matrix. The crack tip (lower micrograph) terminated at an area of discontinuous cracking in the titanium carbide phase only.

1) Fracture of the TiC composite system layer occurred in a mixed ductile/brittle manner:
   a. The titanium carbide phase fractured along coarse brittle facets as shown in FIGS. 4*a*-4*c* b. A low nickel content titanium-nickel alloy phase fractured in a ductile manner as shown in FIG. 4*b*-4*c* c. A higher nickel content titanium-nickel alloy phase fractured along finer brittle facets as shown in FIG. 4*b*-4*c*

Figure 4D:
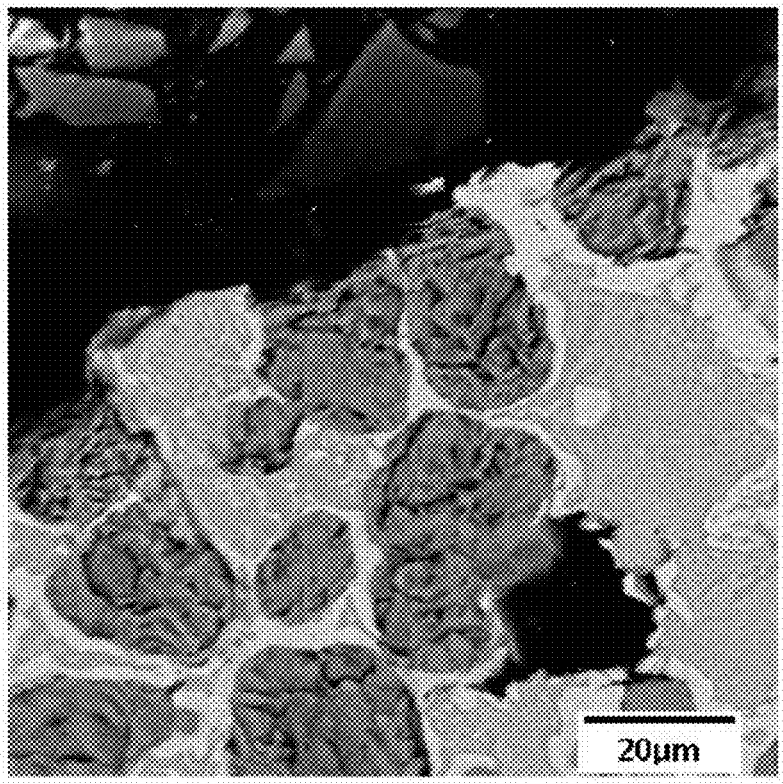
FIG. 4*d* is an SEM micrograph that shows a backscattered electron image of a polished metallographic section through the primary fracture through the TiC composite layer of the tile of FIG. 3*a*. Cracking extended through all three phases. Cracking was not confined to a single phase or to the boundaries between the phases.
Figure 4E:
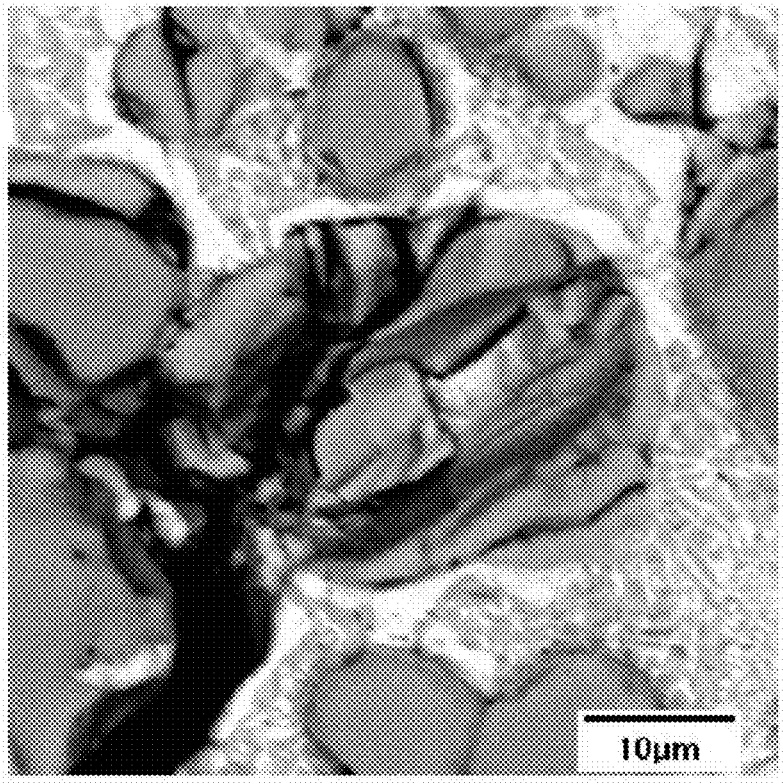
FIG. 4*e* is an SEM micrograph that shows a backscattered electron image of a polished metallographic section through a secondary crack through the TiC composite layer of the tile of FIG. 3*a*. Cracking within the carbide phase is highly branched. Many of the cracks appear to terminate at the carbide to matrix boundary. The creating of multiple branched cracks and crack termination at phase boundaries would predictably absorb energy. The apparent fracture mechanism (crack branching in the carbide phase and crack termination at the phase boundaries) may account for reported good ballistic properties.

The tortuous crack path and frequent changes in direction as the crack propagated through interfaces, as shown in FIG. 4*e*, suggests substantial energy absorption and substantial resistance to cracking relative to other hard materials such as ceramics.

2) Fracture occurred through both the titanium carbide aggregate phase and the two titanium-nickel alloy matrix phases as shown in FIG. 4*d*. Fracture did not preferentially follow phase boundaries.

Figure 4F:
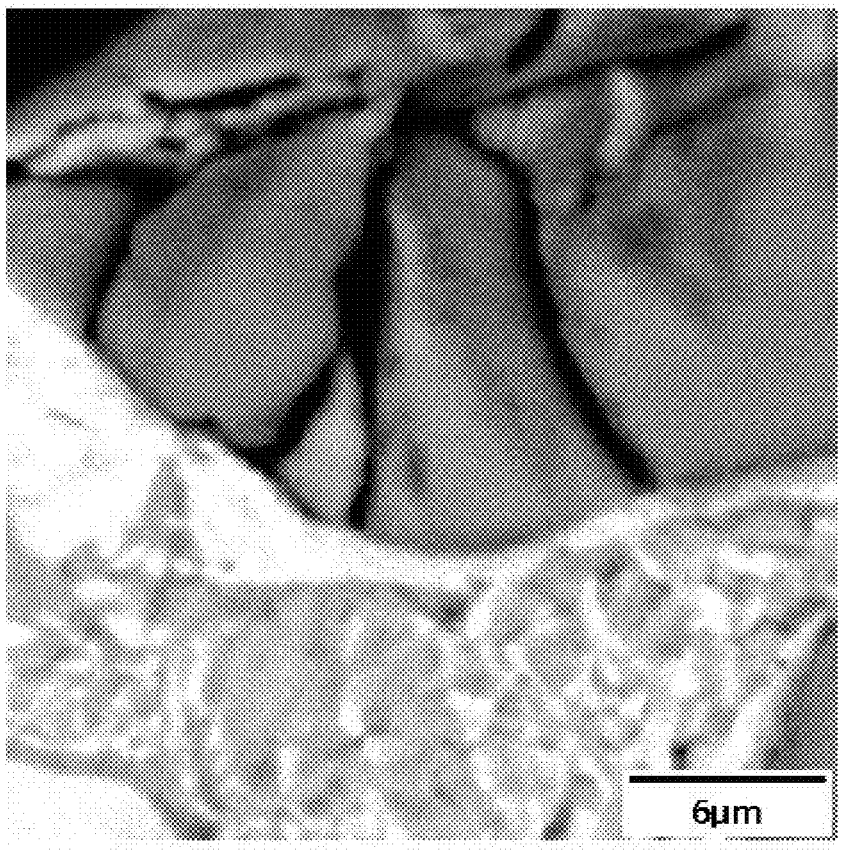
FIG. 4*f* is an SEM micrograph that shows a backscattered electron image of a metallographic section through the primary fracture through the TiC composite layer of the tile of FIG. 3*a*. Branched cracking within the titanium carbide phase and crack termination at the carbide to matrix phase boundary is apparent.

3) Fracture through the titanium carbide phase was heavily branched as shown in FIG. 4*e*-4*f*. Many of the branched cracks terminated at the carbide to matrix interface. These features suggest substantial energy absorption during crack propagation.

Figure 5A:
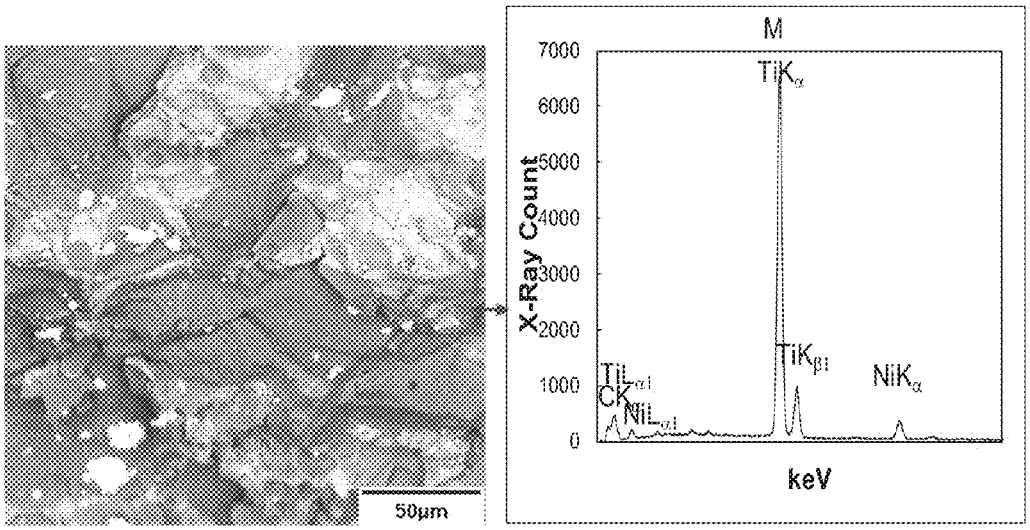
FIG. 5*a* includes an SEM micrograph that shows a backscattered electron image and an energy dispersive x-ray spectra acquired from the failed interface on the TiC composite system layer of the tile of FIG. 3*a*, the two-phase structure and presence of nickel indicating failure within the TiC composite system layer rather than at the titanium to TiC composite system interface.
Figure 5B:
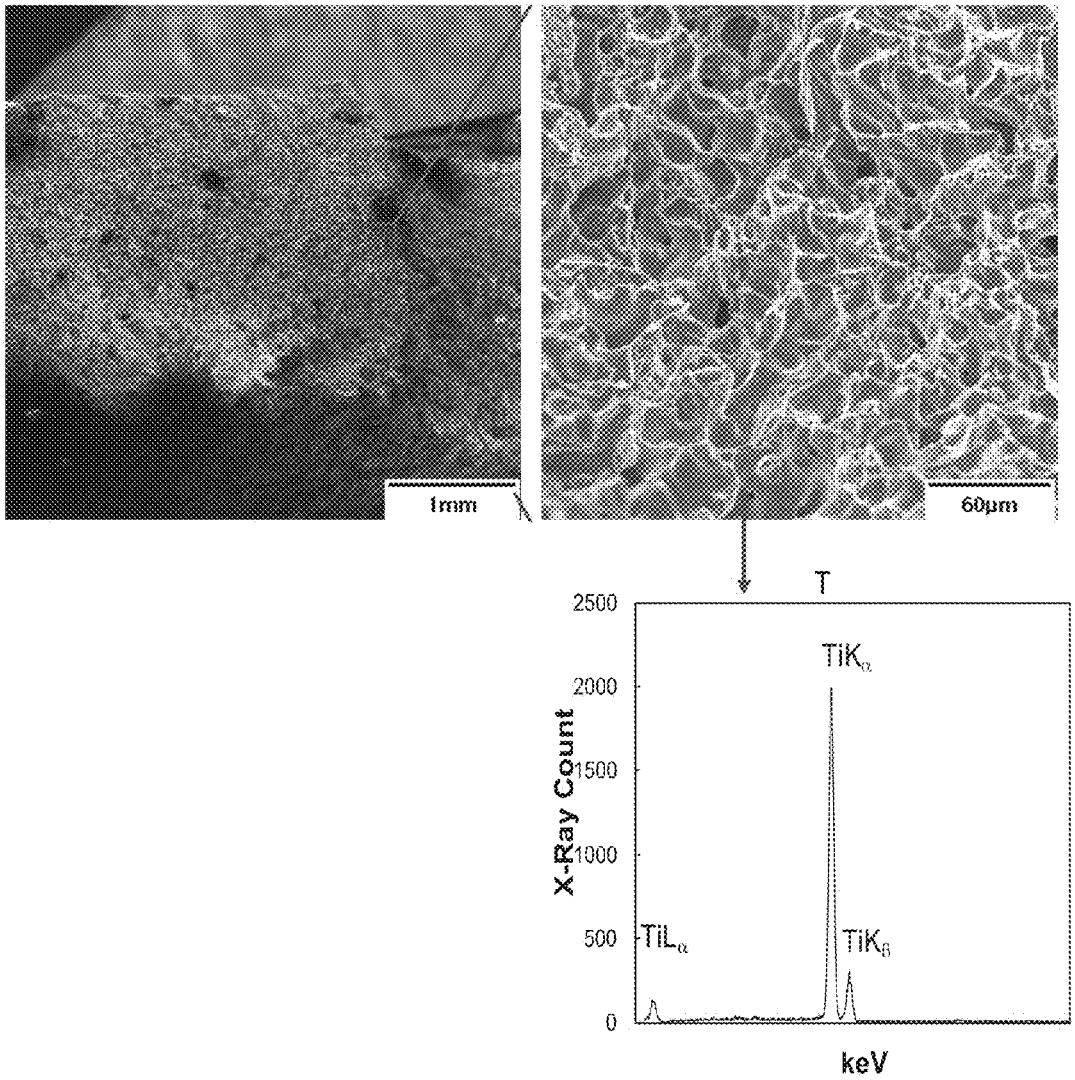
FIG. 5*b* includes SEM micrographs that show backscattered electron images and an energy dispersive x-ray spectra acquired from the fracture in the titanium layer of the tile of FIG. 3*a*, fracture having occurred in a ductile manner.
Figure 5C:
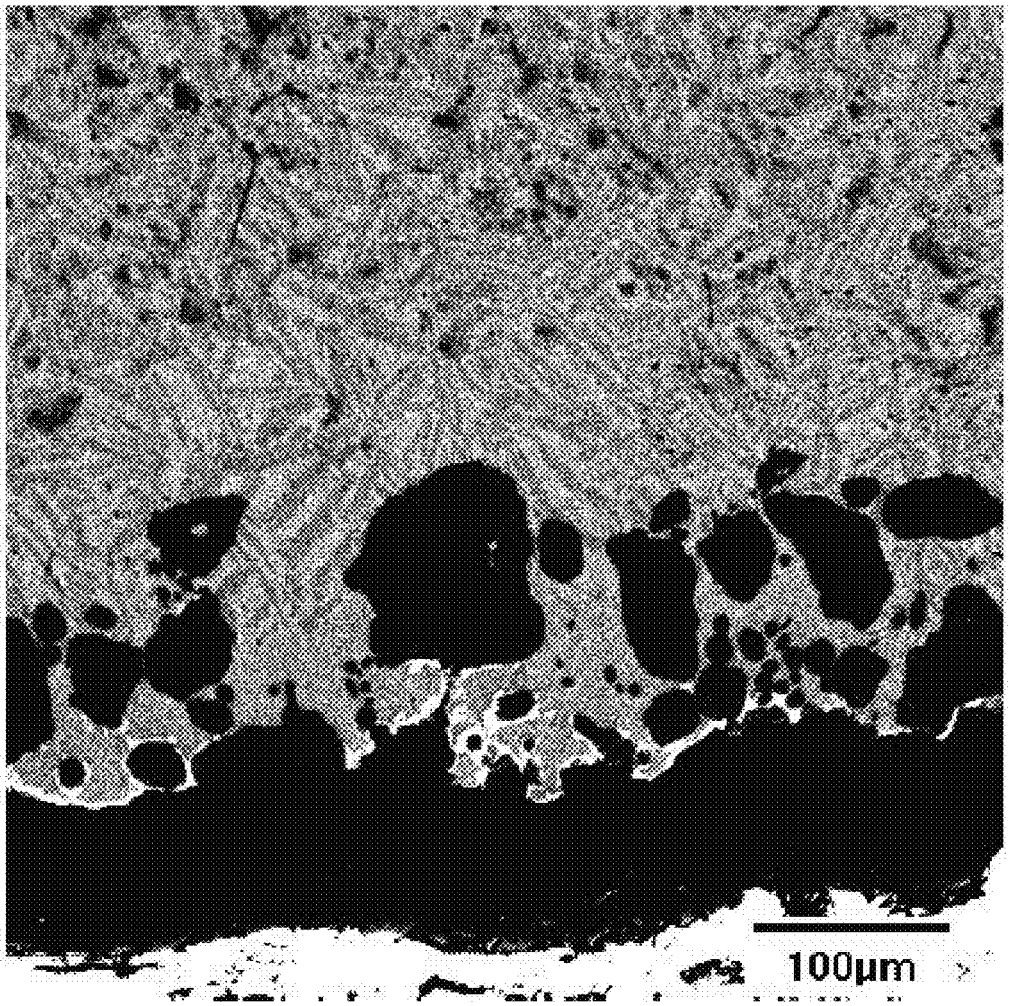
FIG. 5*c* is an SEM micrograph that shows a backscattered electron image of a polished metallographic section through the titanium layer at the separation between the titanium and TiC composite system layers of the tile of FIG. 3*a*, separation having occurred in the TiC composite system layer as evidenced by the adhering TiC composite system material to the titanium layer.

4) Separation between the titanium layer and the TiC composite layer occurred within the TiC composite layer, as shown in FIG. 5*c*.

In comparable tests, ceramic, steel, and TiC tiles produced by conventional methods were fully penetrated by a standard NATO round, with the ceramic and TiC tiles produced by conventional methods broken into fragments.

Figure 5D:
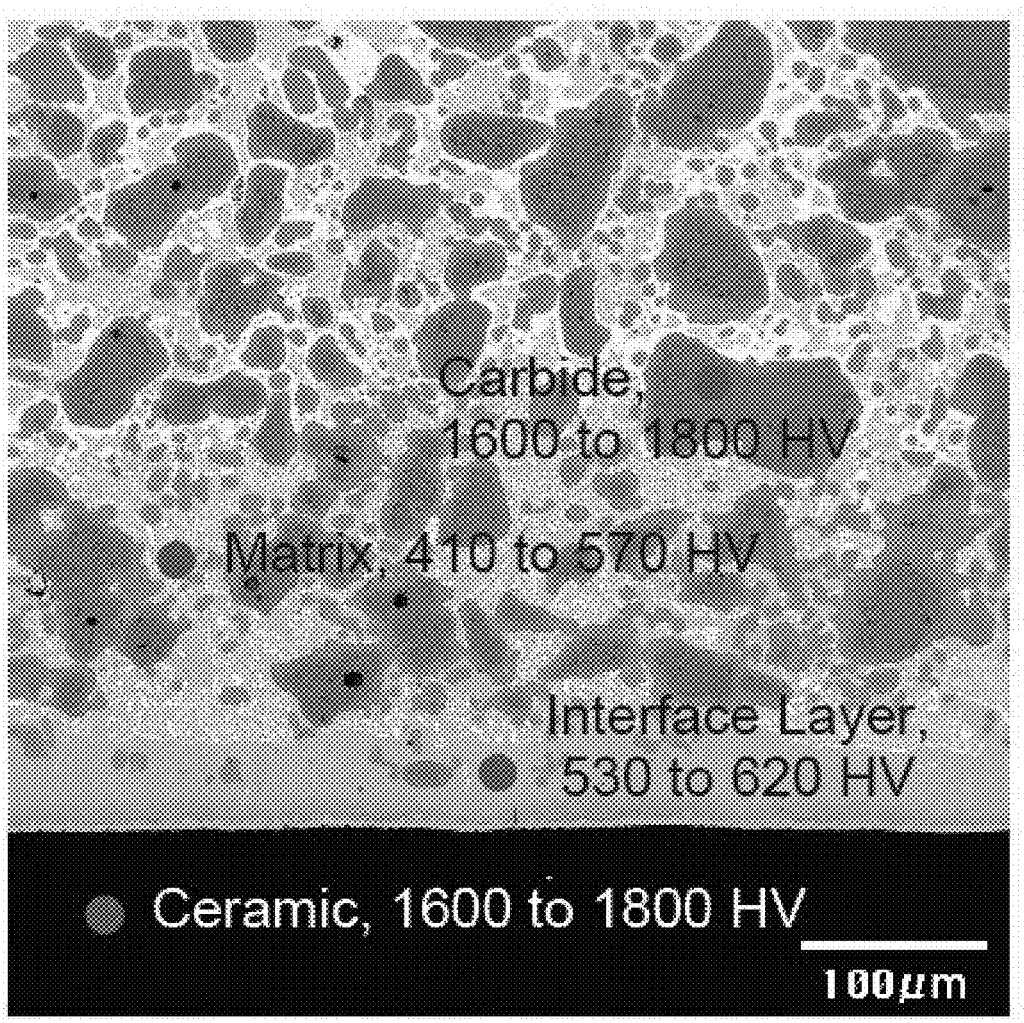
FIG. 5*d* is an SEM micrograph of a metallographic section through the interface of a tile comprising a layer of a TiC composite system described herein bonded to a substrate layer of alumina ceramic showing microhardness test locations and Vickers (HV) hardness data obtained.

Armor tiles may also be made by adhering a body of the TiC composite system to another substrate material such as a ceramic, including those made from alumina, boron carbide and/or silicon carbide by sintering the TiC composite system onto the ceramic material to produce the composite material shown in FIG. 5*d*. A wafer of the TiC composite system was sintered in an alumina ceramic boat, CoorsTek® Catalog No. CR 32 65578. The wafer was bonded to the ceramic boat and could not be removed without breaking the ceramic boat.

Figure 5E:
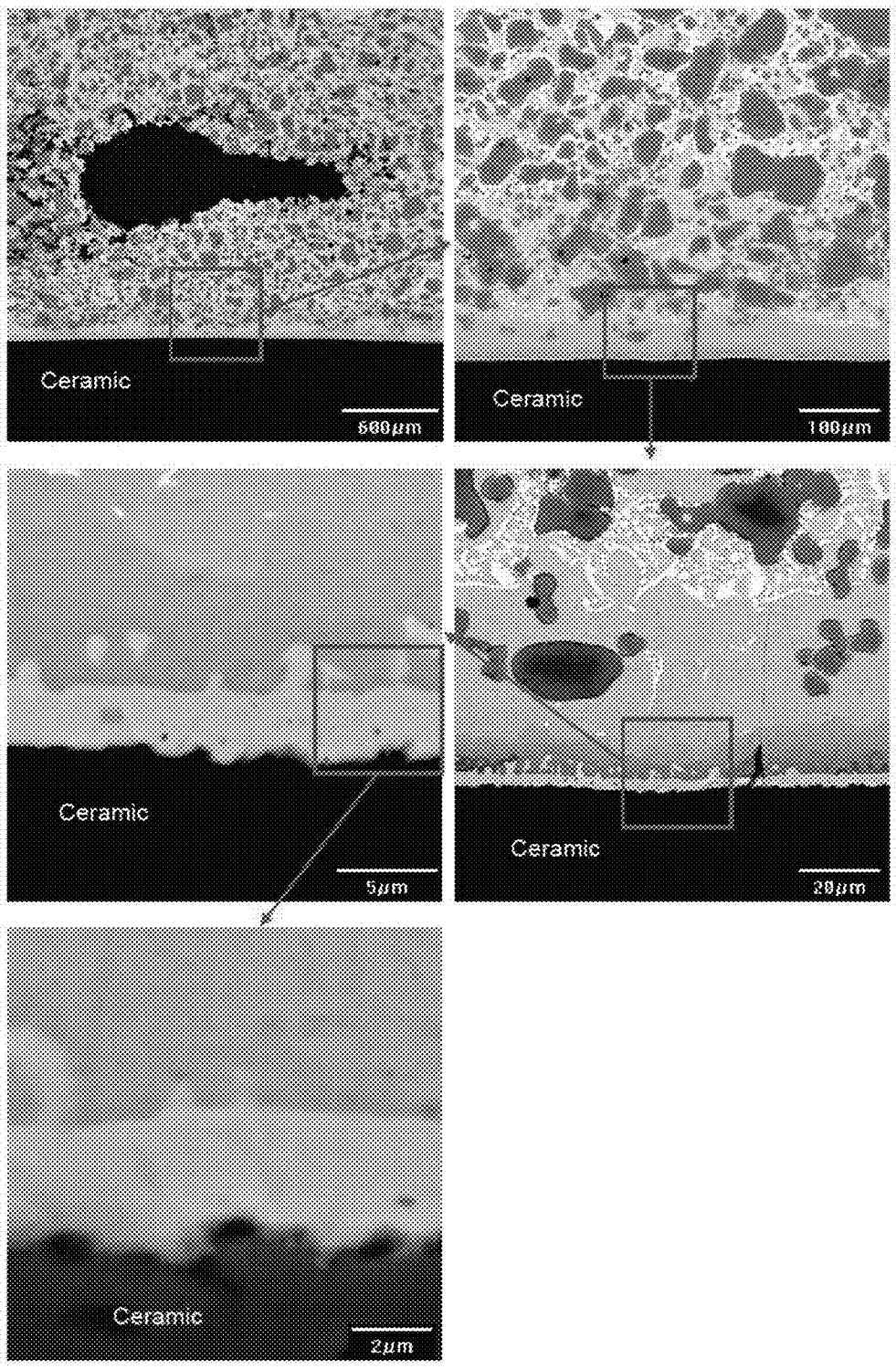
FIG. 5*e* includes SEM micrographs that show increasing magnification backscattered electron images of a metallographic section through the interface of the tile of FIG. 5*d*, with three distinct interface layers apparent between the ceramic (black band at the bottom) and the TiC composite system (multi-phase areas at the tops of the micrographs).

Referring to FIG. 5*e*, it appears that aluminum from the ceramic diffused into the TiC composite system. The diffusion suggests a chemical, perhaps ionic, rather than a simple mechanical bond. It is believed that similar bonds can be formed between the TiC composite system and ceramics substrates containing boron or silicon.

Vickers micro hardness data appears in FIG. 5*d* for the TiC composite system/ceramic composite shown in FIG. 5*e*.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the accompanying claims. For example although specific examples of armor tiles are described herein, it should be appreciated that certain properties of an armor tile, notably size and thickness, will be dictated by the nature of the threat, what density is to be achieved, weight, cost, and other system requirements.

And more generally, described herein is a method for forming a reduced density TiC composite system wherein titanium, aluminum, or a mixture thereof is substituted for at least a portion of one or more of the heavy elements nickel, molybdenum, niobium and tungsten of a known alloy system for cementing carbide powder, such as TiC powder, with the titanium, aluminum, or mixture thereof being substituted in an amount sufficient to reduce the density of the resulting alloy system containing cemented carbide to not more than 5.0 g/cc.

Also more generally described herein is a method for forming a composite system suitable for bonding to a substrate wherein titanium, aluminum, or a mixture thereof is substituted for at least a portion of one or more of the heavy elements nickel, molybdenum, niobium and tungsten of a known alloy system for cementing hard powder, such as TiC powder, with the titanium, aluminum, or mixture thereof being substituted in an amount sufficient that components of the resulting alloy system containing TiC can bond to titanium structures and ceramic structures by sintering.

The invention claimed is:

1. A mixture of materials to be used in the production of a green compact for sintering comprising:

a) 12.5 wt. % to 25 wt. % of a powder comprising
24 wt % to 28 wt. % titanium
7 wt. % to 12 wt. % aluminum
0 wt. % to 0.10 wt. % carbon
0 wt. % to 4.5 wt. % iron
0 wt. % to 4 wt. % silicon
with the balance being nickel and trace elements; and b) 32 wt % to 55 wt % of a hard powder,
with the balance being titanium powder.

2. The mixture of claim 1 wherein the hard powder consists essentially of a material selected from the group consisting powders of $Al_4C_3$, $B_4C$, SiC, $CaC_2$, TiC, TiN, BN, $Al_2O_3$, and mixtures thereof.

3. The mixture of claim 2 wherein the hard powder consists essentially of TiC powder.

4. The mixture of claim 1 wherein the amount of titanium powder is sufficient to impart green strength to the compact to allow subsequent handling and processing of the compact.

5. The mixture of claim 1 wherein all of the powders are less than 425 microns.

6. The mixture of claim 1 wherein at least 50 wt. % of the hard powder is 50 to 150 microns.

7. The mixture of claim 1 wherein at least 60 wt. % of the hard powder is at least 45 microns.

8. The mixture of claim 1 wherein 90 wt. % of the hard powder is at least 150 microns and is less than 425 microns.

9. The mixture of claim 1 wherein 90 wt. % of the hard powder is less than 45 microns.

10. The mixture of claim 1 wherein the titanium powder consists essentially of titanium sponge granules, a powder of titanium that has been made from previously melted or partially melted titanium made by the hydride dehydride process or processes to make spherical powders, or a mixture thereof.

11. The mixture of claim 10 wherein the titanium powder consists essentially of titanium sponge granules.

12. A green compact comprising:

a) 12.5 wt. % to 25 wt. % of a powder comprising
24 wt % to 28 wt. % titanium
7 wt. % to 12 wt. % aluminum
0 wt. % to 0.10wt. % carbon
0 wt. % to 4.5 wt. % iron
0 wt. % to 4 wt. % silicon
with the balance being nickel and trace elements, b) 32 wt % to 55 wt % of a hard powder, and c) titanium powder in an amount sufficient to impart sufficient green strength to the green compact.

13. The green compact of claim 12 wherein the hard powder consists essentially of a material selected from the group consisting powders of $Al_4C_3$, $B_4C$, SiC, $CaC_2$, TiC, TiN, BN, $Al_2O_3$, and mixtures thereof.

14. The green compact of claim 13 wherein the hard powder consists essentially of TiC powder.

15. The green compact of claim 12 wherein all of the powders are less than 425 microns.

16. The green compact of claim 12 wherein at least 50 wt. % of the hard powder is 50 to 150 microns.

17. The green compact of claim 12 wherein at least 60 wt. % of the hard powder is at least 45 microns.

18. The green compact of claim 12 wherein 90 wt. % of the hard powder is at least 150 microns and is less than 425 microns.

19. The green compact of claim 12 wherein 90 wt. % of the hard powder is less than 45 microns.

20. The green compact of claim 12 wherein the titanium powder consists essentially of titanium sponge granules, a powder of titanium that has been made from previously melted or partially melted titanium made by the hydride dehydride process or processes to make spherical powders, or a mixture thereof.

21. The green compact of claim 20 wherein the titanium powder consists essentially of titanium sponge granules.

22. A method for forming a layered composite structure, the method comprising:

providing a solid substrate body consisting of a ceramic material, titanium, a titanium alloy, aluminum, or an aluminum alloy;

providing a volume of a composite system precursor powder consisting essentially of a mixture of claim 1; and bonding the volume of powder to the substrate body.

23. The method of claim 22 wherein the bonding comprises:

placing the body of the composite system into physical contact with the volume of powder in a closed die;

compressing the body of the composite system and the volume of powder within the closed die to form a green compact; and heating the green compact to sinter the powder and to cause the powder to form a solid body bonded to the body of the composite system.

24. The method of claim 22 wherein the bonding comprises sintering at 900° C. to 1400° C. for 1 minute to 8 hours.

25. The method of claim 22 wherein the substrate body is a wafer.

26. A method for forming a layered composite structure, the method comprising:

providing a layer of a composite system precursor powder consisting essentially of a mixture of claim 1 in a die;

providing a layer of substrate precursor powder consisting essentially of titanium powder, titanium alloy powder, aluminum powder, aluminum alloy powder, or a mixture of such powders in contact with the layer of composite system precursor powder in the die;

compressing the materials within the die to form a green compact; and heating the green compact sufficiently to sinter the composite system precursor powder and form a layered composite structure.

27. The method of claim 26 wherein the substrate precursor powder is a mixture that consists essentially of 88 wt. % to 98 wt. % titanium powder and 2 wt. % to 12 wt. % aluminum powder.

28. A method for forming a layered composite structure, the method comprising:

providing a solid substrate body consisting of a ceramic material, titanium, a titanium alloy, aluminum, or an aluminum alloy;

providing a green compact of claim 12 in contact with the substrate body; and heating the substrate body and the green compact to a sufficient temperature to sinter the green compact and cause the substrate body and the sintered green compact to be bonded together upon cooling.

* * * * *